United States Patent [19]

Oexler

[11] Patent Number: 4,503,663

[45] Date of Patent: Mar. 12, 1985

[54] OPEN-END SPINNING ROTOR

[75] Inventor: Rudolf Oexler, Ingolstadt, Fed. Rep. of Germany

[73] Assignee: Schubert & Salzer, Ingolstadt, Fed. Rep. of Germany

[21] Appl. No.: 481,368

[22] Filed: Apr. 1, 1983

[30] Foreign Application Priority Data

Apr. 6, 1982 [DE] Fed. Rep. of Germany ..... 3212785

[51] Int. Cl.[3] ..... D01H 1/135; D01H 7/882

[52] U.S. Cl. ..... 57/404; 57/414

[58] Field of Search ..... 57/400, 404, 406, 414, 57/416; 403/261, 326

[56] References Cited

U.S. PATENT DOCUMENTS

| | | | |
|---|---|---|---|
| 1,192,404 | 7/1916 | Ewart | 403/261 |
| 3,331,258 | 7/1967 | Eckerle et al. | 403/261 X |
| 3,822,541 | 7/1974 | Croasdale et al. | 57/416 |
| 3,845,612 | 11/1974 | Chisholm et al. | 57/416 X |
| 4,016,713 | 4/1977 | Lauger et al. | 57/414 |
| 4,319,449 | 3/1982 | Hofmann | 57/414 |
| 4,339,911 | 7/1982 | Hofmann | 57/416 |

*Primary Examiner*—Donald Watkins

*Attorney, Agent, or Firm*—Dority & Manning

[57] ABSTRACT

An open-end spinning rotor located on a rotor shaft (20) having a collar (3). The open-end spinning rotor (1) is pressed against the collar (3) by means of a clamping disk (4). The collar (3) is designed as a second clamping disk (31) which is attached to the rotor shaft (20) in an opposite arrangement to that of the first clamping disk (4).

6 Claims, 3 Drawing Figures

OPEN-END SPINNING ROTOR

BACKGROUND OF THE INVENTION

The present invention relates to an open-end spinning rotor which is located on a rotor shaft.

Since open-end spinning rotors are subject to wear, they have to be exchanged from time to time.

It is, therefore, known to provide a two-part open-end spinning rotor, the actual rotor body being fastened to a basic body by means of an engagement connection (German Offenlegungsschrift No. 2,939,326) or a releasable connection spatially separate from the centering surfaces (German Offenlegungsschrift No. 2,939,325). Here, although the rotor body can be exchanged on its own, without the remaining part (the basic body and the rotor shaft) having to be exchanged, nevertheless, this advantage is gained at the expense of a relatively costly design of the basic body. Moreover, there remains the problem of a releasable connection between the spinning rotor and the rotor shaft, which is simple and yet is suitable for high speeds.

SUMMARY OF THE INVENTION

The object of the present invention is, therefore, to provide a simple and secure connection which can be made economically between the spinning rotor and the rotor shaft, and this connection will also be easy to break again, so that the spinning rotor can be exchanged independently of its shaft.

This object is achieved, according to the invention, due to the fact that the rotor shaft carries a collar, and the open-end spinning rotor is pressed against the collar by means of an elastic clamping disk. The clamping disk is attached to the rotor shaft so that its middle portion is pressed against the rotor base from the open rotor side, with the result that the clamping disk, the outer margin of which is supported on the rotor base, assumes a plane shape. The end of the rotor shaft located in the rotor interior and the elastic clamping spring braced on this end are arranged concentrically to the open-end spinning rotor and rest smoothly in the rotor interior with the result that they cause neither disturbance of the airflow nor clogging with fibers or dust. Moreover, the rotor shaft and the clamping disk project only a very slight amount above the rotor base so that the rotor shaft and the clamping disk do not extend into the region of rotation of the thread being drawn off. Furthermore, it is very simple to attach a clamping disk to the rotor shaft and, consequently, to fasten the open-end spinning rotor on its shaft. After the open-end spinning rotor has been attached to the rotary shaft and after the clamping disk has been attached, the latter is merely pressed in the direction of the collar, with the result that the spinning rotor is also held securely against the collar. The clamping disk is pressed flat and thereby clamped.

At the same time, the outer edge of the clamping disk is supported on the rotor base and its inner edge is supported on the rotor shaft. By simply exerting axial pressure on the rotor shaft from the rotor interior, this clamp can be overcome without difficulty and the connection between the spinning rotor and the rotor shaft released again, when this is desirable, for example to exchange the spinning rotor.

In principle, the collar can also be provided in the rotor interior on the end of the rotor shaft, so that the clamping disk, for example, a cup spring, exerts axial pressure on the spinning rotor from the outside of the latter.

The solution, according to the invention, is extremely simple. While clamping disks are conventionally intended for applying relatively high spring forces in a relatively small space and, therefore, have a relatively large amount of play in a radial direction, according to the invention, the fit between the rotor shaft and the clamping disk are made very narrow, so that the clamping disk is supported on the rotor shaft and thus holds the spinning rotor in a specific position against the collar. Also, as a result of this exact positioning, no unbalance arises, but, on the contrary, exact true running of the spinning rotor is guaranteed.

The collar can be an integral part of the rotor shaft. So that the rotor shaft can have a simple design, however, the collar is preferably not made an integral part of the rotor shaft, but is fastened releasably to this rotor shaft. In this case, also, the collar can have different designs.

According to a preferred design of the subject of the invention, the collar is designed as a second elastic clamping disk which is attached to the rotor shaft in an opposite arrangement to that of the first clamping disk and is clamped. The fastening connection between the open-end spinning rotor and the rotor shaft is made in a similar way as already described.

When a single drive is provided for the openend spinning rotor, then, in a further design of the subject of the invention, this individual drive is appropriately fastened to the rotor shaft in the way described above because located between the collar and the clamping disk is the base of an armature which is part of this individual drive for the open-end spinning rotor.

It is especially advantageous if there is on the rotor shaft, for receiving the clamping disk and the openend spinning rotor, a centering portion which is offset in a suitable way in relation to the rotor shaft, for example, by means of a different diameter or even by means of a collar ring located on the rotor shaft. Appropriately, especially when the rotor shaft has, at its end located in the open-end spinning rotor, a collar integrated with the rotor shaft, and the clamping disk therefore has to be threaded on to the rotor shaft from the end of the latter which faces away from the open-end spinning rotor, the diameter of the centering portion is greater than the diameter of the rotor shaft. This makes it easier to fasten the open-end spinning rotor on the rotor shaft. Furthermore, it is more favorable to secure clamping disks on a large diameter than on a small diameter.

The subject of the invention permits simple assembly of the spinning rotor on the rotor shaft. The open-end spinning rotor can be produced, as desired, in a cutting process or in a non-cutting process. The type of fastening of the spinning rotor to its shaft, according to the invention, is the prerequisite for being able to remove the spinning rotor quickly from its shaft and replace it with a new spinning rotor. This makes stock-keeping considerably easier, normally it is only necessary to change the spinning rotors and not the rotor shafts.

Because of the exact retention of the spinning rotor on the rotor shaft by means of clamping disks of low mass, any unbalance which occurs can be kept at an extremely low level even at high rotational speeds, with the result that the rotor shaft and the rotor mounting have a long life.

BRIEF DESCRIPTION OF DRAWINGS

The invention is explained in more detail below with reference to the drawings in which.

DESCRIPTION OF THE PREFERRED EMBODIMENT

Figure 1:
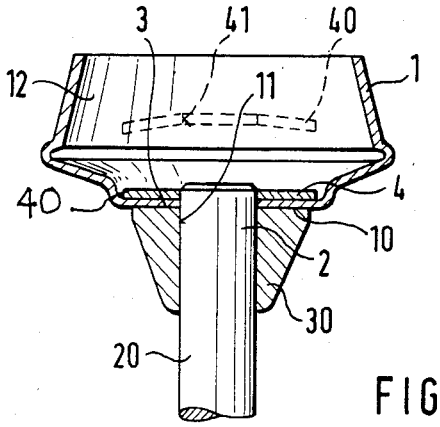
FIG. 1 shows, in section, an open-end spinning rotor, with a connection to the rotor shaft which is made according to the invention.

The open-end spinning rotor 1 illustrated in FIG. 1 is formed from sheet metal without cutting and has a plane rotor base 10 with a central orifice 11. The spinning rotor 1 rests on the end of a rotor shaft 20, a centering portion 2 of which projects through this orifice 11 into the rotor interior 12. The outside diameter of the centering portion 2 and the diameter of the orifice 11 match one another, so that the spinning rotor 1 is exactly fixed radially in relation to the centering portion 2.

A thrust ring 30, the collar 3 of which serves as a bearing for the spinning rotor 1, is provided on this rotor shaft 20 or on the centering portion 2 at a distance from the end located in the rotor interior 12. This thrust ring 30 is fastened to the rotor shaft 20 or the centering portion 2 by means of a locking screw (not shown) or by being pressed on, shrunk on, or the like. The collar 3 therefore surrounds the centering portion 2 annularly.

Arranged on a smooth surface upper portion or end of the centering portion 2 located in the rotor interior 12 is a clamping disk 4 which as a result of its prestress, presses the spinning rotor 1 against the collar 3. As shown by broken lines in FIG. 1, the clamping disk 4 is attached to the end of the centering portion 2 so that the outer edge 40 is supported on the rotor base 10 while the inner edge 41 is located at a distance from the rotor base 10. While the spinning rotor 1 is supported on the outside of the rotor base 10, the inner edge 41 of the clamping disk 4 is pressed against the rotor base 10 from the rotor interior 12 by means of a suitable tool, with a result that the inner edge 41 of the clamping disk 4 is clamped firmly against the centering portion 2 and is prevented from returning to the released position. Thus, the clamping disk 4 holds the spinning rotor 1 firmly against the collar 3. This is achieved by an appropriate matching choice of the outside diameter of the centering portion 2 and the inside diameter of the clamping disk 4. These two diameters are coorindated with one another so that they form a press fit for the clamping disk 4 on the centering portion 2. The requisite exact inside diameter of the clamping disk 4 is obtained, for example, by means of precision stamping.

If the spinning rotor 1 is to be subsequently removed from the rotor shaft 20, for example, because the spinning rotor 1 has become useless as a result of wear or, instead, a spinning rotor 1 of different size or geometry is to be provided, it is sufficient to press the centering portion 2 out of the spinning rotor 1 from the rotor interior 12 and thereby release the clamping disk 4. This can be done at once with conventional simple pressure devices. During operation, practically no high axial forces, but predominantly radial forces arise on the spinning rotor 1. There is, therefore, no danger that the spinning rotor 1 will become detached from the centering portion 2 during spinning.

The collar 3 can have various designs. Thus, the clamping disk 4 and the collar 3 can be spatially interchanged. For example, the collar used can be a ring which is located within the spinning rotor 1 and which is fastened on or attached to the end of the centering portion 2. In such a design, the clamping disk presses the spinning rotor 1 against the collar from outside.

Figure 2:
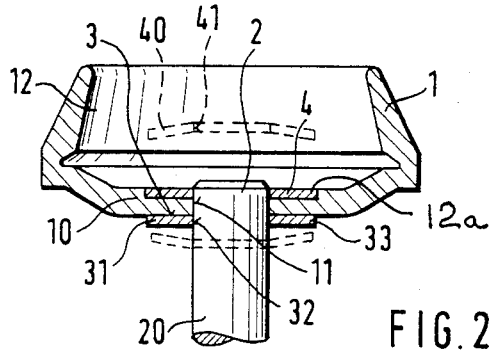
FIG. 2 shows a modification of the subject of the invention, according to which the spinning rotor is fastened to the rotor shaft by means of two clamping disks.

FIG. 2 illustrates another advantageous design of a collar 3. Here, the collar 3 is formed by a second clamping disk 31 which is located on the centering portion 2 of the rotor shaft 20. As shown by broken lines in FIG. 2, the clamping disks 4 and 31 are attached to the centering portion 2 so that the inner edge 41 and 32, respectively, of their curved middle portion is located at a distance from the rotor base 10, while their outer edge **12*a* and 33, respectively, already rests against the rotor base 10. The clamping disk 31 is, therefore, arranged outside the spinning rotor 1, on the centering portion 2 in an opposite arrangement to that of the clamping disk 4** located in the rotor interior.

To clamp the two clamping disks 4 and 31 and consequently to fasten the spinning rotor 1 on the centering portion 2 of the rotor shaft 20, pressure is exerted on the clamping disks 4 and 31 simultaneously from both sides and exactly in alignment with the longitudinal axis of the centering portion 2, the middle portions of the clamping disks being pressed against one another, so that, after the clamping disks 4 and 31 are released, their inner edges 41 and 32 are supported on the centering portion 2 and thus grip the spinning rotor 1 between them.

When this connection between the spinning rotor 1 and the rotor shaft 20 is to be broken again, it is merely necessary to support the spinning rotor 1 via the clamping disk 31 and press out the centering portion 2 from the rotor interior 12 in a similar way to that already described with reference to FIG. 1.

Figure 3:
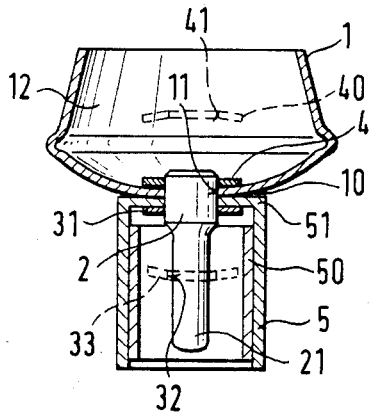
FIG. 3 shows a modification of the device illustrated in FIG. 2, in which an individual drive is assigned to each spinning rotor.

As a comparison of FIGS. 1 and 2 shows, the spinning rotor 1 can be produced without cutting or by cutting. However, the bearing or the drive of the spinning rotor 1 can also be made in different ways. Thus, there can be for each spinning rotor 1 an individual drive which has an armature 5 connected to the spinning rotor 1 and carrying permanent magnets 50 on its inside wall (FIG. 3). These permanent magnets 50 are part of an electric motor (not shown). In this design, the centering portion 2 is part of a bearing journal 21 which forms the rotor shaft and which carries and supports the complete unit consisting of the spinning rotor 1 and the armature 5.

The spinning rotor 1 is fastened here in the same way as explained with reference to FIG. 2. The only difference is that the base 51 of this armature 5 is located between the clamping disk 4 in the rotor interior 10 and the clamping disk 31 forming the collar 3. Consequently, the collar 3 which can, in principle, also have a different design from that of FIG. 3, and the clamping disk 4 serve not only for fastening and clamping the spinning rotor 1, but also for fastening the armature 5 to the bearing journal 21. Fastening takes place in the way described above.

The form of the rotor shaft 20 is not governed by the designs illustrated. On the contrary, it embraces any element, irrespective of its shape and length, which serves for supporting the spinning rotor 1. The term "rotor shaft" also includes tubular and socket-like designs.

According to FIG. 3, the rotor shaft takes the form of a bearing journal 21 which is relatively small and which has a centering portion 2, which is of larger diameter, only in its region serving for fastening the spinning rotor 1 and the armature 5. The bearing journal 21 therefore has a low mass, but nevertheless, because of the diameter of the centering portion which is larger than the diameter of the bearing journal 21, possesses such a large supporting surface for the clamping disks 4 and 31 that secure retention of the spinning rotor 1 and the armature 5 in a radial arrangement relative to the bearing journal is guaranteed.

The rotor shaft 20 or bearing journal 21 need therefore only conform to the requirements of the mounting while the centering portion 2 should conform to the requirements of the rotor fastening (or the fastening of an armature 5).

If, instead of the clamping disk 4, a collar integrated with the rotor shaft 20 or with the bearing journal 21 is provided in the interior of the open-end spinning rotor 1, the clamping disk 31 must be pushed on from the end of the rotor shaft 20 or the bearing journal 21 which faces away from the spinning rotor 1. Even this can be carried out more easily because the diameter of the rotor shaft 20 or of the bearing journal 21 designed as a rotor shaft is reduced in comparison with the diameter of the centering portion 2.

The term "clamping disk" in the preceding description will embrace all elements (for example, cup springs) which make it possible, without a special formation or machining of the centering portion 2 and the spinning rotor 1, to fasten the spinning rotor 1 to the centering portion 2 by prestressing. Equivalents of this kind therefore come within the scope of the subject of the present invention.

While a preferred embodiment of the invention has been described using specific terms, such description is for illustrative purposes only, and it is to be understood that changes and variations may be made without departing from the spirit or scope of the following claims.

I claim:

1. An open-end spinning rotor assembly comprising:

a rotor shaft having a smooth surface, a collar carried on said rotor shaft, a spinning rotor having an open interior carried on said rotor shaft with said smooth surface upper portion of said rotor shaft extending into said interior of said rotor, and a clamping disk carried on said smooth surface upper portion of said shaft pressing and spinning rotor against said collar securing said rotor on said shaft.

2. An open-end spinning rotor assembly as claimed in claim 1, wherein the collar is fastened releasably to the rotor shaft.

3. An open-end spinning assembly as claimed in claim 2, wherein the collar is designed as a second clamping disk which is attached to the rotor shaft in an opposite arrangement to that of the first clamping disk and is clamped against an opposite side of said rotor.

4. An open-end spinning rotor assembly as claimed in claim 1 further comprising:

an armature of a motor of an individual drive for said open-end spinning rotor located between said collar and said clamping disk.

5. An open-end spinning rotor assembly as claimed in claim 1 wherein a centering portion is provided on said rotor shaft (20) for receiving said clamping disk (4) and the open-end spinning rotor (1).

6. An open-end spinning rotor as claimed in claim 4, wherein the diameter of the centering portion (2) is greater than the diameter of the rotor shaft (20).

* * * * *